US007927130B2

(12) United States Patent
Fukuda

(10) Patent No.: US 7,927,130 B2
(45) Date of Patent: Apr. 19, 2011

(54) ELECTRONIC APPARATUS AND CONNECTOR MODULE USED FOR THIS ELECTRONIC APPARATUS

(75) Inventor: Takashi Fukuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/858,873

(22) Filed: Aug. 18, 2010

(65) Prior Publication Data

US 2010/0311270 A1 Dec. 9, 2010

Related U.S. Application Data

(63) Continuation of application No. PCT/JP2008/056384, filed on Mar. 31, 2008.

(51) Int. Cl.
*H01R 3/00* (2006.01)

(52) U.S. Cl. ..... 439/488

(58) Field of Classification Search ..... 439/488, 439/489; 340/635; 324/538
See application file for complete search history.

(56) References Cited

U.S. PATENT DOCUMENTS

| | | | | |
|---|---|---|---|---|
| 5,494,453 | A * | 2/1996 | Tsuji et al. | 439/381 |
| 5,716,232 | A * | 2/1998 | Endo et al. | 439/595 |
| 6,476,616 | B2 * | 11/2002 | Yoshida | 324/538 |

FOREIGN PATENT DOCUMENTS

| | | |
|---|---|---|
| JP | 61-206183 | 9/1986 |
| JP | 1-102876 | 4/1989 |
| JP | 6-18748 | 1/1994 |
| JP | 7-272794 | 10/1995 |
| JP | 2000-91033 | 3/2000 |
| JP | 2002-343486 | 11/2002 |

OTHER PUBLICATIONS

International Search Report for PCT/JP2008/056384, mailed Jul. 1, 2008.

* cited by examiner

*Primary Examiner* — Phuong K Dinh
(74) *Attorney, Agent, or Firm* — Staas & Halsey LLP

(57) ABSTRACT

An electronic apparatus wherein at least one detachable module is inserted into a rack and the module is connected with the rack by male/female connector, wherein it is made possible to detect any bending of pins of the male connector before the module is mounted in the rack and therefore incomplete mounting of the module to the rack can be prevented. A light source with high linearity is provided at each of the pins at the male connector side, while conversely a light receiving unit of light is provided at each of the receptacles at the female connector side. Before connection of the connectors, if all receiving units receive light, normality of the pins is detected. Instead of providing the light receiving units at the female connector side, providing a reflecting part at the female connector side and providing a light receiving unit at the male connector side is possible.

20 Claims, 12 Drawing Sheets

ELECTRONIC APPARATUS AND CONNECTOR MODULE USED FOR THIS ELECTRONIC APPARATUS

CROSS-REFERENCE TO RELATED APPLICATION

This application is a continuation application based upon and claiming priority of PCT application No. PCT/JP2008/056384, filed on Mar. 31, 2008, the contents being incorporated herein by reference.

FIELD

This application relates to an electronic apparatus and a connector module used for this electronic apparatus. In particular, this application relates to an internal connector used for an information processing system.

BACKGROUND

In the past, in electronic apparatuses, for example, information apparatuses such as servers, several detachable modules have been housed in a shelf unit called a "rack" to form a single electronic apparatus. In such an electronic apparatus, in general, there are connectors deep inside the rack, and there are connectors at the back sides of the modules. When these modules are plugged into the rack, the connectors provided at their back surfaces are connected with the rack side connectors resulting in the rack and the modules being electrically connected.

Each detachable module is inserted from the front side of the rack, so it is not possible to visually confirm the connection state of the module side connector and the rack side connector. Therefore, in the past, two guide pins have been provided at the rack side board, while guide holes for receiving the guide pins have been provided at the back surface of the detachable module. Further, when attaching the detachable module to the rack, first, the guide pins at the rack have been inserted into the guide holes at the back surface of the detachable module. The guide holes, for example, have large diameter openings and use tapered slanted surfaces to guide the guide pins into the guide holes. If pushing the detachable module into the rack in the state with the front ends of the guide pins inserted into the guide holes, the connector of the detachable module is positioned at the position of the rack side connector and the connectors are correctly connected without positional deviation.

On the other hand, a connection device provided with a mechanism for detecting a locked state where the two connectors are correctly connected and an incomplete locked state by the passage of an optical signal is disclosed in Japanese Laid-Open Patent Publication No. 61-206183. The connection device disclosed in Japanese Laid-Open Patent Publication No. 61-206183 includes a male connector provided with a plurality of pins and a female connector provided with receptacles corresponding to the pins. Furthermore, end faces of optical fibers are exposed at predetermined positions where the male connector body and the female connector body face each other at the time of lock. This connection device detects that the lock mechanism is completely locked when optical signals are transmitted through the optical fibers at the time of connection of the connectors and detects that the lock mechanism is incompletely locked when the optical signals are not transmitted or the amounts of transmission of the optical signals are small.

However, in conventional devices, it was necessary to provide inherently unnecessary holes or places not allowing mounting at the board in order to provide the guide pins, so the wiring on the board was restricted. Further, even if requiring that the connectors not become deviate in position at the time of connection by the use of the guide pins and receptacles, if the pins of a connector are bent from the start due to manufacturing defects etc., it was not possible to prevent the problems due to bent pins. Further, in the connection device described in Japanese Laid-Open Patent Publication No. 61-206183, even if incomplete lock of the connectors could be detected, poor connection due to bent pins could not be detected at the time of connection.

SUMMARY

A first aspect of an electronic apparatus includes an electronic apparatus at which at least one detachable module is attached to a casing, provided with a first connector which is attached to a board provided in the casing corresponding to each of the modules and which has a plurality of parallel pins, a second connector which is provided at a surface of each of the modules for connection with the casing and which has receptacles corresponding to the pins, and a monitoring unit which monitors the states of the pins before connection of the first and second connectors, the monitoring unit provided with an emission instructing unit which instructs the emission of light to all of the pairs of the pins and the receptacles of the first and second connectors from one to the other, a pin state detecting unit which detects whether the emitted light has arrived at all of the pairs of the pins and the receptacles to thereby detect the states of the pins, and a pin abnormality detecting unit which determines the pins are abnormal and emits an alarm when the emitted light does not arrive at least at one of the pairs.

Further, the connector module includes a connector module provided with a first connector in which a plurality of pins are arranged in parallel and a second connector having receptacles corresponding to the pins, characterized by being provided with a light emitting unit which emits light from one to the other of a pair of a pin and receptacle of the first and second connectors for all of the pairs, a light receiving unit which is provided at either one of the pin side and the receptacle side and outputs detection output indicating if the emitted light has been normally received at all of the pairs in accordance with the received state of the emitted light, and a detecting unit which uses the detection output from the light receiving unit to detect if the pins are normal in state.

DESCRIPTION OF EMBODIMENTS

Before describing the embodiments, an explanation will be given of the connectors depicted in FIGS. 1A and 1B.

Figure 1A:
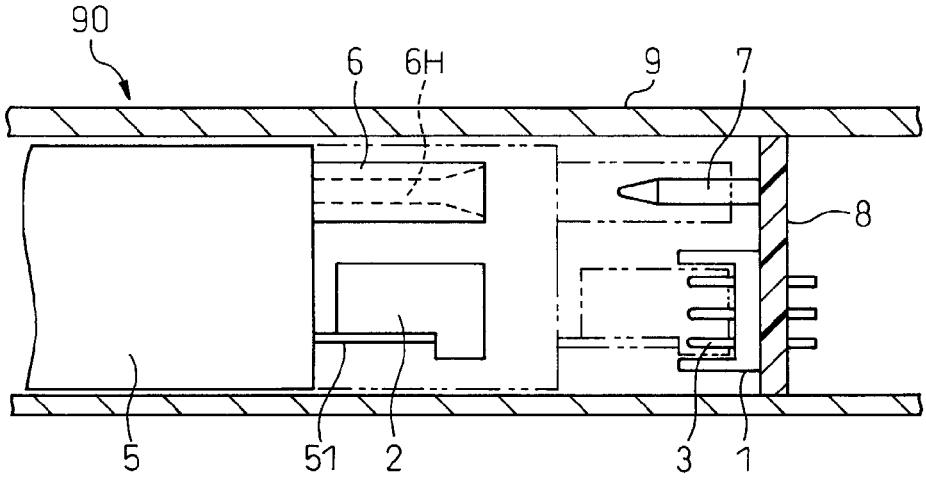
FIG. 1A is a side view which illustrates conventional connection of a detachable module and a rack.
Figure 1B:
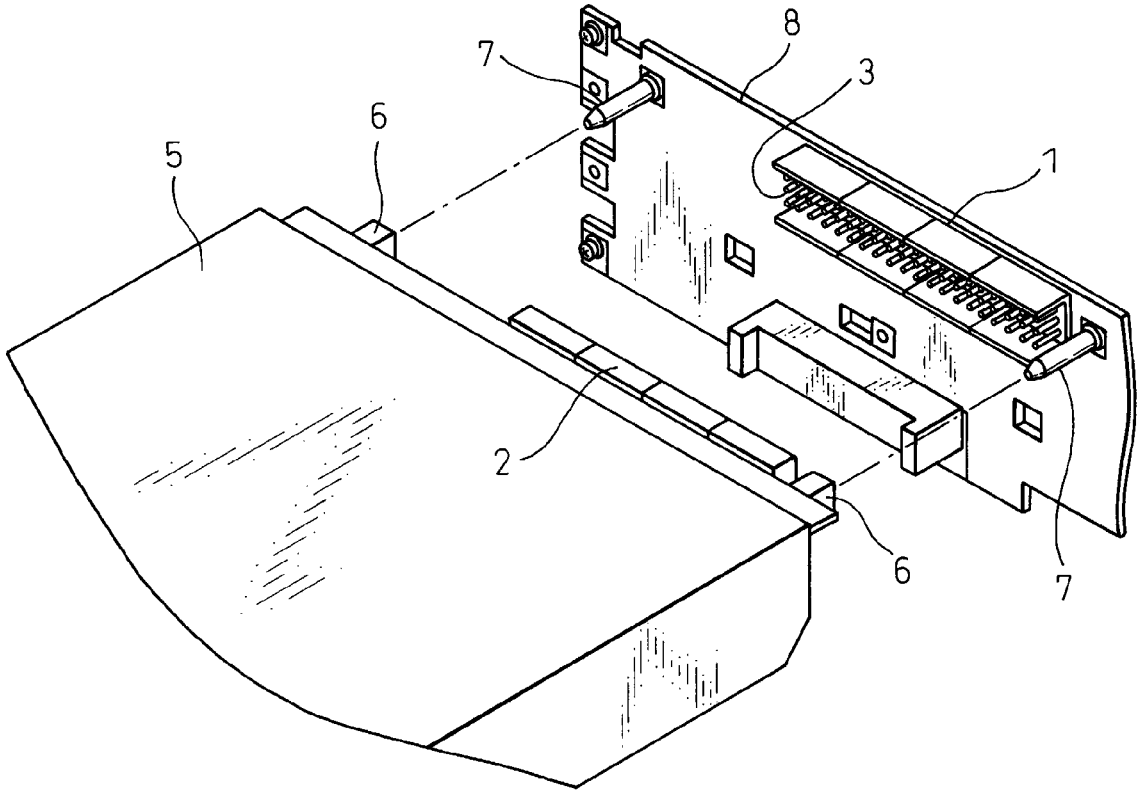
FIG. 1B is a perspective view of the location depicted in FIG. 1A.

FIG. 1A and FIG. 1B illustrate a method of positioning connectors with each other when attaching a detachable module 5 to a rack 9 of an electronic apparatus 90. Inside the rack 9, there is a board 8 for attachment of the detachable module 5. A connector 1 is attached to this board 8. On the other hand, at a back surface of the detachable module 5, there is a mounting board 51. This mounting board 51 is provided with a connector 2 for connection with the connector 1 attached to the board 8 of the rack 9. In general, the connector 1 attached to the board 8 is a male connector having pins 3, while the connector 2 provided at the back surface of the detachable module 5 is a female connector. For this reason, the state of the pins 3 of the connector 1 is not able to be visually checked from the outside.

Further, in the past, to enable reliable positioning of the connector 1 and connector 2, two guide pins 7 were provided at the board 8 of the rack 9 and sleeves 6 having guide holes 6H for receiving the guide pins 7 were provided at the back surface of the detachable module 5. When attaching the detachable module 5 to the rack 9, first, the guide pins 7 at the board 8 were inserted into the guide holes 6H at the sleeves 6 at the back surface of the detachable module 5.

The guide holes 6H, for example, as depicted in FIG. 1A, had large diameters. Tapered surfaces guided the guide pins 7 into the guide holes 6H. By pushing the detachable module 5 into the rack 9 in the state with the guide pins 7 inserted into the guide holes 6H, the connector 2 was positioned with the position of the connector 1 and the connectors 1 and 2 were correctly connected without positional deviation. Note that, the connectors 1 and 2 were actually provided at the positions depicted in FIG. 1B, but in FIG. 1A, for explanation of the connected state of the connectors 1 and 2, the positions of the connectors 1 and 2 are shifted in the downward direction from the actual positions.

In this way, in an electronic apparatus 90, guide pins 7 were provided, so the board 8 was provided with inherently unnecessary holes and parts not allowing mounting of devices. The wiring on the board 8 was therefore restricted. Further, even if requiring that the connectors 1 and 2 not deviate in position at the time of connection, if the pins 3 of the connector 1 at the board, which is difficult to be visually checked, are bent from the start due to manufacturing defects etc., it was not possible to prevent poor connection of the connector 1 and the connector 2 due to bent pins.

Therefore, the configuration of a connector module to be provided inside a rack 9 which can detecting bending of the pins 3 when inserting a detachable module 5 in the rack 9 and can thereby solve the problems in the related art and the configuration of an electronic apparatus 50 using this connector module will be illustrated below using FIG. 2A to FIG. 12.

Note that, members used in the electronic apparatus 90 illustrated in FIGS. 1A and 1B which are similarly used in the embodiments illustrated below will be assigned the same reference notations in the explanation.

Figure 2A:
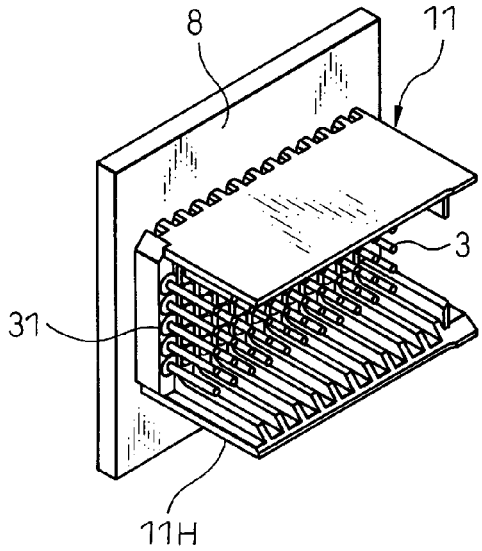
FIG. 2A is a perspective view of the configuration of a first embodiment of a connector provided at a rack side.
Figure 2B:
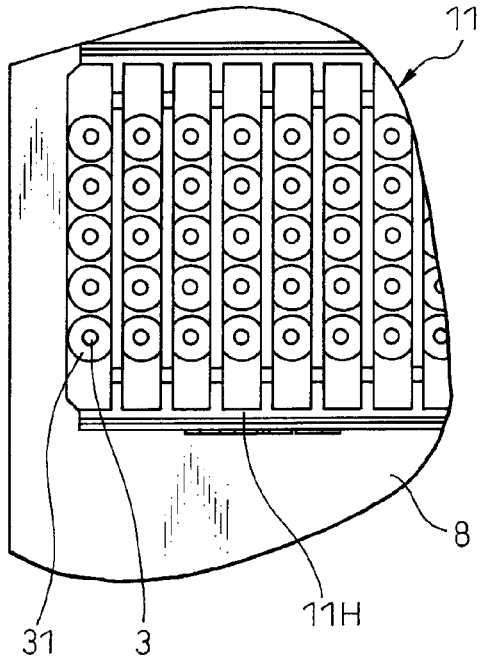
FIG. 2B is a partial enlarged front view of the connector of FIG. 2A.

FIG. 2A and FIG. 2B illustrate the configuration of a male connector 11 of the first embodiment provided at the rack 9 side illustrated in FIG. 1A and FIG. 1B. As depicted in FIG. 1B, in actuality, the board 8 of the rack 9 is provided with a large number of connectors 1 (four), but here it is assumed that the board 8 is provided with a single connector 11. The connector 11 of the first embodiment includes a housing 11H in which a large number of pins 3 are provided in the same way as a connector 1.

Furthermore, the connector 11 of the first embodiment is provided with circular light emitting units 31 concentric with the pins 3 at the surface of the housing 11H at which the pins 3 are attached. Further, the light emitting units 31 are designed to emit highly linear light proceeding in parallel with the axial directions of the pins 3, for example, laser beams emitted from a laser light source.

Figure 2C:
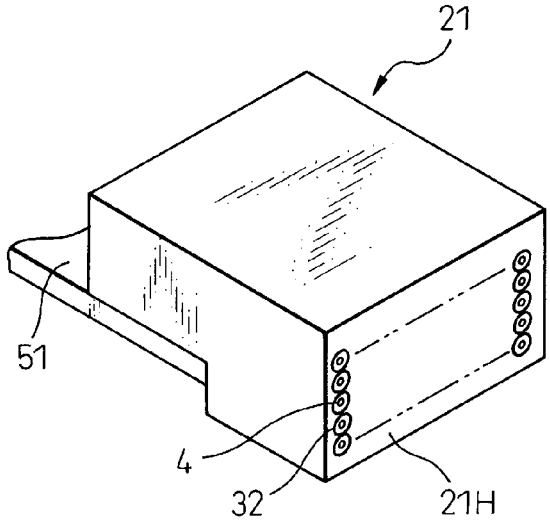
FIG. 2C is a perspective view of the configuration of a first embodiment of a connector provided at a detachable module side.
Figure 2D:
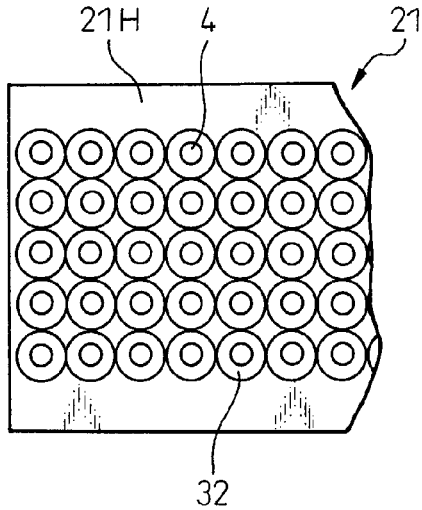
FIG. 2D is a partial enlarged front view of the connector of FIG. 2C.

Next, FIG. 2C and FIG. 2D illustrate the configuration of a female connector 21 of a first embodiment provided at a mounting board 41 at the detachable module 5 side illustrated in FIG. 1A and FIG. 1B. The connector 21 of the first embodiment is provided, at the surface of a housing 21H where receptacles 4 for receiving the pins 3 are provided, with light receiving units 32 of the same shapes as the light emitting units 31 provided at the connector 11. Further, the light receiving units 32 have detectors for detecting the amounts of light input to the light receiving units 32. The configuration of the detectors will be described later.

Figure 3A:
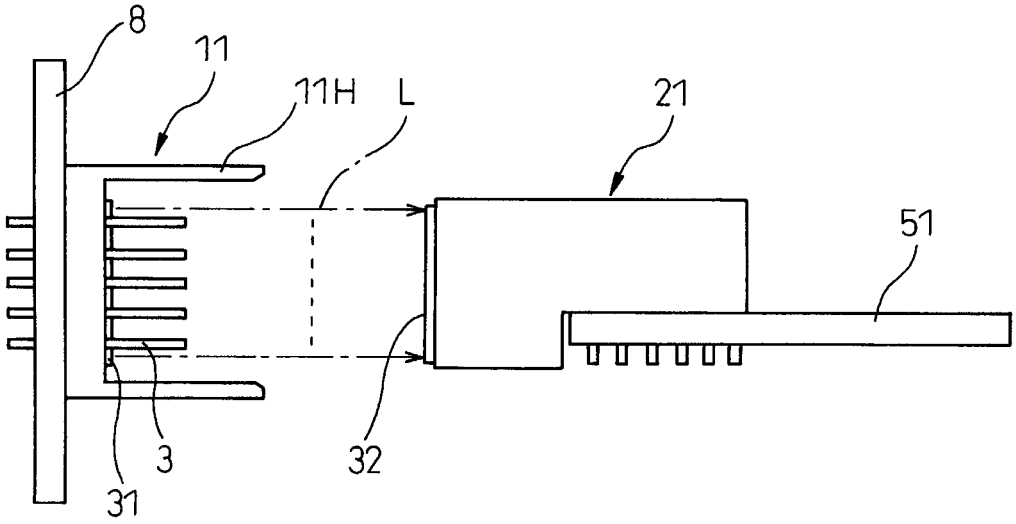
FIG. 3A is a side view illustrating a state before connection of the connectors illustrated from FIG. 2A to FIG. 2D.

FIG. 3A depicts the state before connection of the male connector 11 and female connector 21 illustrated from FIG. 2A to FIG. 2D. The light emitting units 31 at the bases of the pins 3 of the male connector 11 emit laser beams L parallel with the pins 3. These laser beams L are received by the light receiving units 32 provided at the front end of the female connector 21. When the pins 3 of the male connector 11 are not bent and all pins 3 are inserted into the receptacles of the female connector 21, the laser beams L from the light emitting units 31 strike a total light receiving unit 32, whereby the fact of the male connector 11 and the female connector 21 being normally connected can be learned at the detachable module 5 provided with the female connector 21.

Figure 3B:
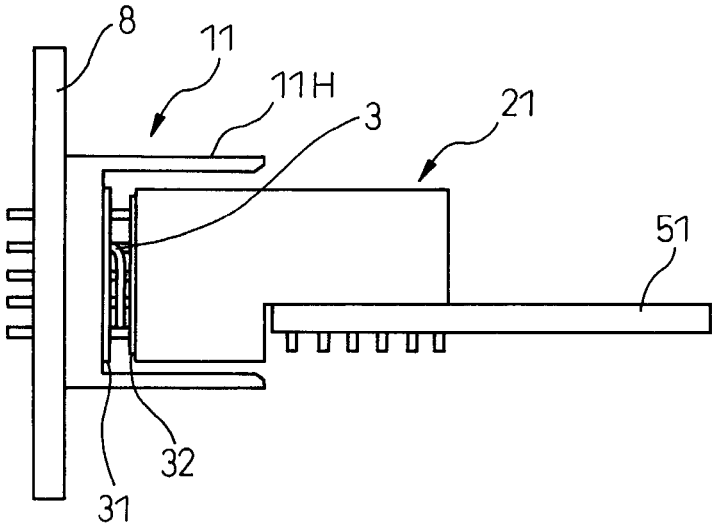
FIG. 3B is a side view illustrating a state where the pins of a connector illustrated in FIG. 3A are bent and the connectors are connected with the pins in the bent state.

FIG. 3B illustrates the state where the pins 3 of the connector 11 illustrated in FIG. 3A were bent, but the detachable module 5 was pushed into the rack 9 in that state and as a result the male connector 11 and the female connector 21 are connected with the pins 3 as bent. When the pins 3 of the male connector 11 are bent, if the pins 3 are inserted into the receptacle of the female connector 21, the laser beams L from the light emitting units 31 will be blocked by the bent pins 3 and will not strike the total light receiving unit 32. Therefore, it is possible to detect bending of pins 3 before pushing the detachable module 5 into the rack 9, so it is possible to prevent a worker from pushing the detachable module 5 into the rack 9 without knowing about the bending of the pins 3.

Figure 4:
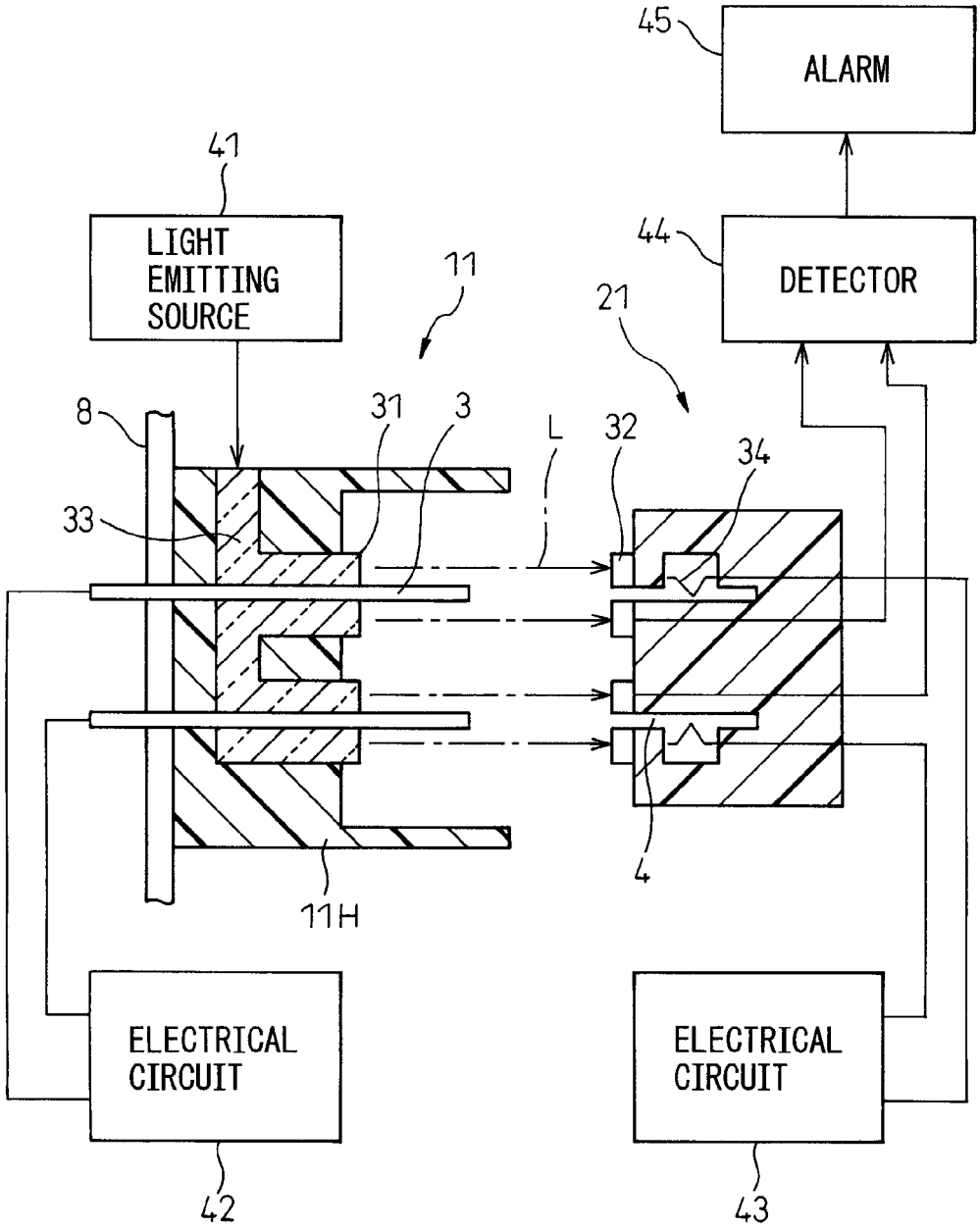
FIG. 4 is an explanatory view illustrating a specific configuration of male/female connectors used in a first embodiment and connection with electrical circuits etc.

FIG. 4 illustrates an example of the specific configuration of the male/female connectors 11, 21 of the first embodiment and the connection with electrical circuits etc. As described above, the connector 11 of the first embodiment is provided with circular light emitting units 31 concentric with the pins 3 at the surface of the housing 11H where the pins 3 are attached. The light emitting units 31 are connected by a light guide member 33. An end of the light guide member 33 is exposed at a predetermined surface of the housing 11H. Outside of the connector 11, a laser light source or other light emitting source 41 is provided. Further, the pins of the connector 11 are connected to an electrical circuit 41 provided at the rack side. Due to this configuration, a laser beam from the light emitting source 41 runs through the light guide member 33, is emitted from the light emitting units 31 at the base parts of the pins 3, and proceeds in parallel with the axial direction of the pins 3.

On the other hand, the connector 21 of the first embodiment is provided with, at the surface where the receptacles 4 are provided for receiving the pins 3 of the housing 21H, light receiving units 32 of the same shape as the light emitting units 31 provided at the connector 11. Further, inside the receptacles 4, there are contacts 34 which electrically connect with the pins 3. The contacts 34 are connected by wires to an electrical circuit 43 at the detachable module 5 side. For the light receiving units 32, CCDs, CMOS's, or other photo-electric conversion devices may be used. Electrical signals are output from them in accordance with the intensity of the received light.

The electrical signals indicating the intensities of the received light output from the light receiving units 32 are input to a detector 44 provided outside of the connector 21. The detector 44 analyzes the electrical signals indicating the intensities of the received light output from the light receiving units 32 and detects if the amounts of light from the light emitting units 31 input to the light receiving units 32 add up to the total amount. This detector 44 is connected to an alarm 45. Further, when the detector 44 judges that the amounts of light from the light emitting units 31 input to the light receiving units 32 do not add up to the total amount, it sends a signal to the alarm 45 to make it emit an alarm sound. Due to this alarm sound, a worker trying to attach this detachable module 5 to a rack 9 can learn of bending of the pins 3, so it is possible to stop the worker from pushing the detachable module 5 into the rack 9 in the middle.

Figure 5:
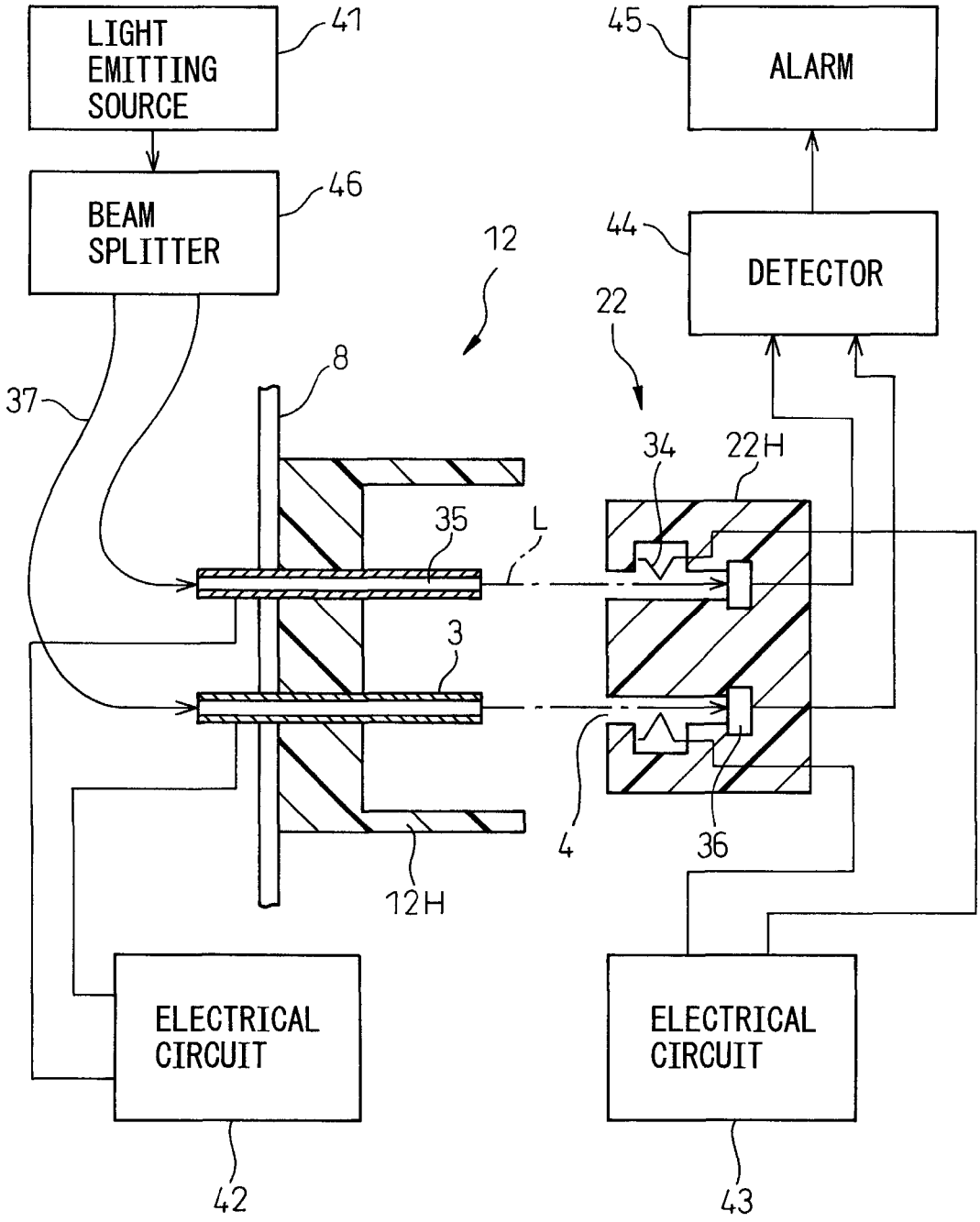
FIG. 5 is an explanatory view illustrating a specific configuration of male/female connectors used in a second embodiment and connection with electrical circuits etc.

FIG. 5 illustrates an example of the specific configuration of the male/female connectors 12, 22 of the second embodiment and the connection with electrical circuits etc. In the connector 12 of the second embodiment, light emitting units 35 are provided inside pins 3 attached to a housing 12H. The light emitting units 35 are connected to light conducting wires (optical fibers) 37, while the light conducting wires 37 are connected outside of the housing 12H through a beam splitter 46 to a light emitting source 41 similar to the first embodiment. The pins 3 of the connector 21 are connected to an electrical circuit 42 provided at the rack side in the same way as well. Due to this configuration, a laser beam from the light emitting source 41 runs through the light conducting wires 3 to the light emitting units 35 inside the pins 3, is emitted from the front ends of the pins 3, and proceeds in parallel with the axial direction of the pins 3.

On the other hand, the connector 22 of the second embodiment includes a housing 22H in which receptacles 4 for receiving the pins 3 are provided. Inside the receptacles 4, there are contacts 34 which electrically connect with the pins 3, while at the bottoms of the receptacles 4, there are light receiving units 36 which receive laser beams from the light emitting units 35 of the pins 3. The contacts 34 are connected by wires to an electrical circuit 43 at the detachable module 5 side. The light receiving units 36 are provided with CCDs, CMOS's, or other photo-electric conversion devices and output electrical signals in accordance with the intensity of the received light.

The electrical signals indicating the intensities of the light received from the light receiving units 36 are input to a detector 44 provided outside of the connector 22. The detector 44 analyzes the electrical signals indicating the intensities of the light received from the light receiving units 32 and detects if the amounts of light from the light emitting units 31 input to the light receiving units 32 add up to the total amount. This detector 4 is connected to an alarm 45.

Further, in the second embodiment, when the pins 3 are not bent, the laser beams emitted from the light emitting units 35 of all pins 3 are input to all of the receptacles 4 in the total amount. As opposed to this, when the pins 3 are bent, not all of the laser beams emitted from the light emitting units 35 of all of the pins 3 are input to all of the receptacles 4—there are light receiving units 36 where the amounts of light received are small. If, in this way, the detector 44 determines that there are light receiving units 36 where the amounts of light input from the light emitting units 35 are not the full amounts, it sends a signal to the alarm 45 to make it emit an alarm sound. Due to this alarm sound, a worker can learn of bending of the pins 3 and can stop the operation of pushing the detachable module 5 into the rack 9 in the middle.

Figure 6A:
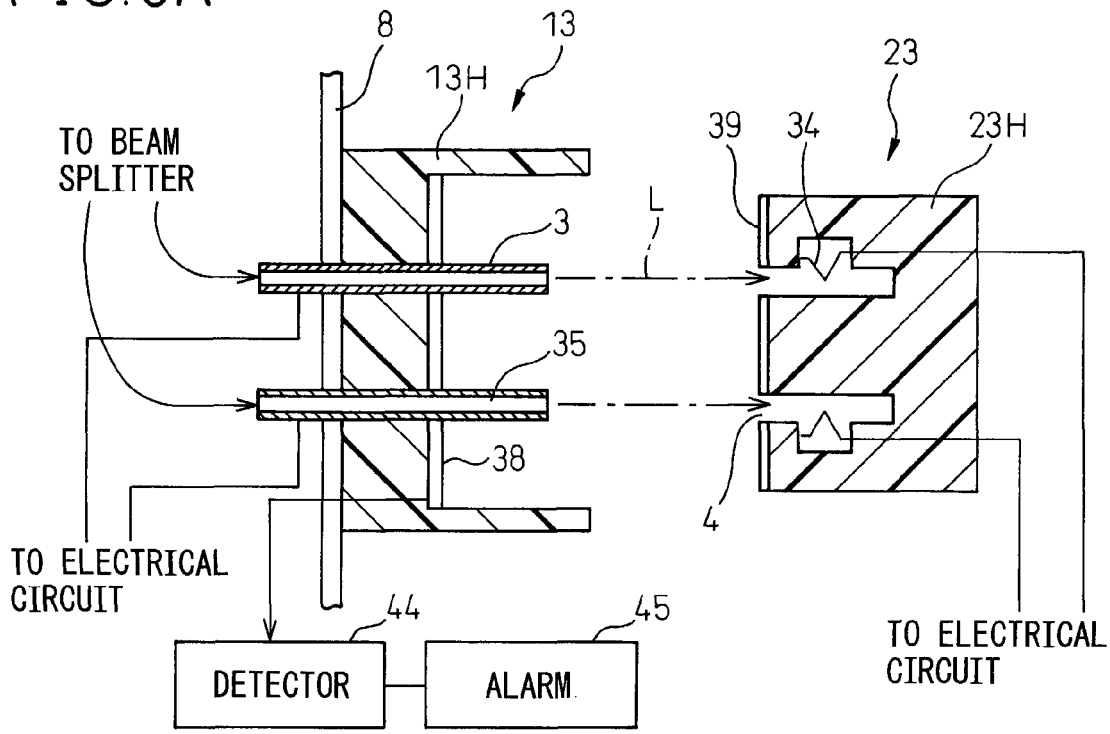
FIG. 6A is an explanatory view illustrating a specific configuration of male/female connectors used in a third embodiment and connection with an alarm.

FIG. 6A illustrates an example of the specific configuration of the male/female connectors 13, 23 of the third embodiment. In the connector 13 of the third embodiment as well, light emitting units 35 are provided inside the pins attached to a housing 13H. The light emitting units 35 are connected with a beam splitter 46 and the pins 3 are connected with electrical circuits in the same way as the second embodiment, so illustration will be omitted here.

The point by which the connector 13 of the third embodiment differs from the connector 12 of the second embodiment is the point that the light receiving units 38 are provided at the bases of the pins 3 of the housing 13H. The light receiving units 38 are also configured by CCDs, CMOS's, and other photo-electric conversion devices and output electrical signals indicating the intensities of the received light. The light receiving units 38 are provided with a detector 44 and alarm 45 provided outside the connector 23 in the same way as the second embodiment.

On the other hand, the connector 23 of the third embodiment includes a housing 23H provided with receptacles 4 for receiving the pins 3 and provided with a mirror 39 around the openings of the receptacles 4 of the housing 23H. Inside the receptacles 4, there are contacts 34 which electrically connect with the pins 3. The point of the contacts 34 being connected by wires to an electrical circuit 43 at the detachable module 5 side is the same as in the second embodiment.

Figure 6B:
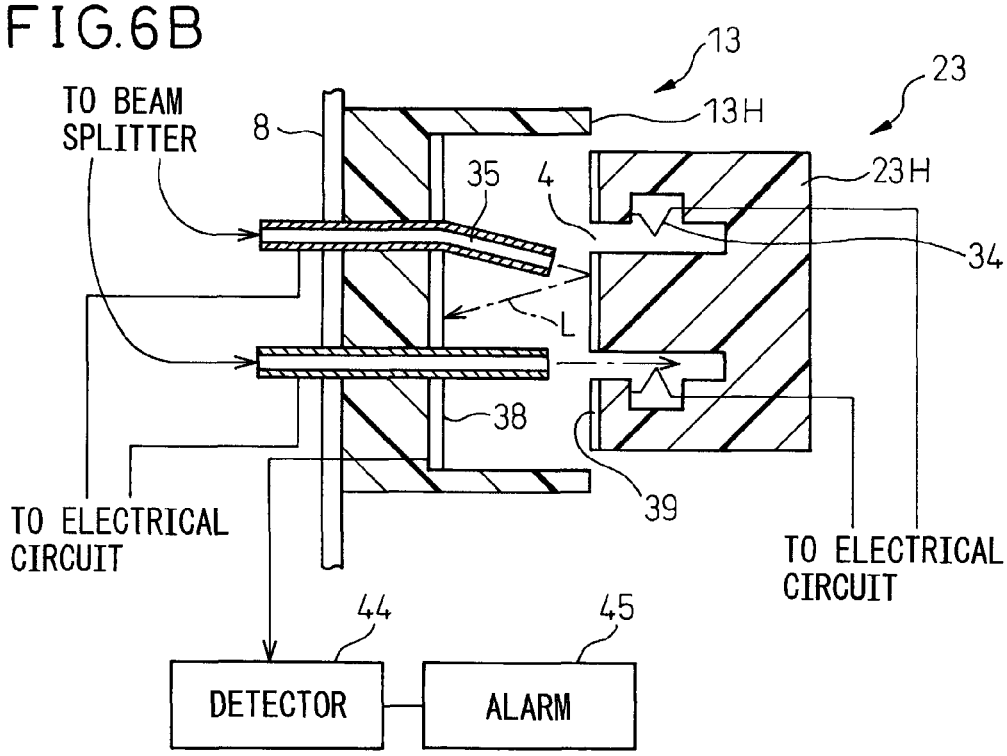
FIG. 6B is an explanatory view illustrating a state where the pins are bent when connecting male/female connectors configured as in FIG. 6A.

In such a third embodiment, when the pins 3 are not bent, as depicted in FIG. 6A, the laser beams L emitted from the light emitting units 35 of all pins 3 are input to all of the receptacles 4 in the total amount. As opposed to this, when the pins 3 are bent, as depicted in FIG. 6B, the laser beams L emitted from the light emitting units 35 of the bent pins 3 are not input to the receptacles 4, but are reflected at the mirror 39 and reach the light receiving units 38 of the connector 13. If the light receiving units 38 detect reflected light, they notifies this to the detector 44. The detector 44 sends a signal to the alarm 45 to make it emit an alarm sound. Due to this alarm, a worker can learn of bending of the pins 3 and can stop the operation of pushing the detachable module 5 into the rack 9 in the middle.

Figure 7A:
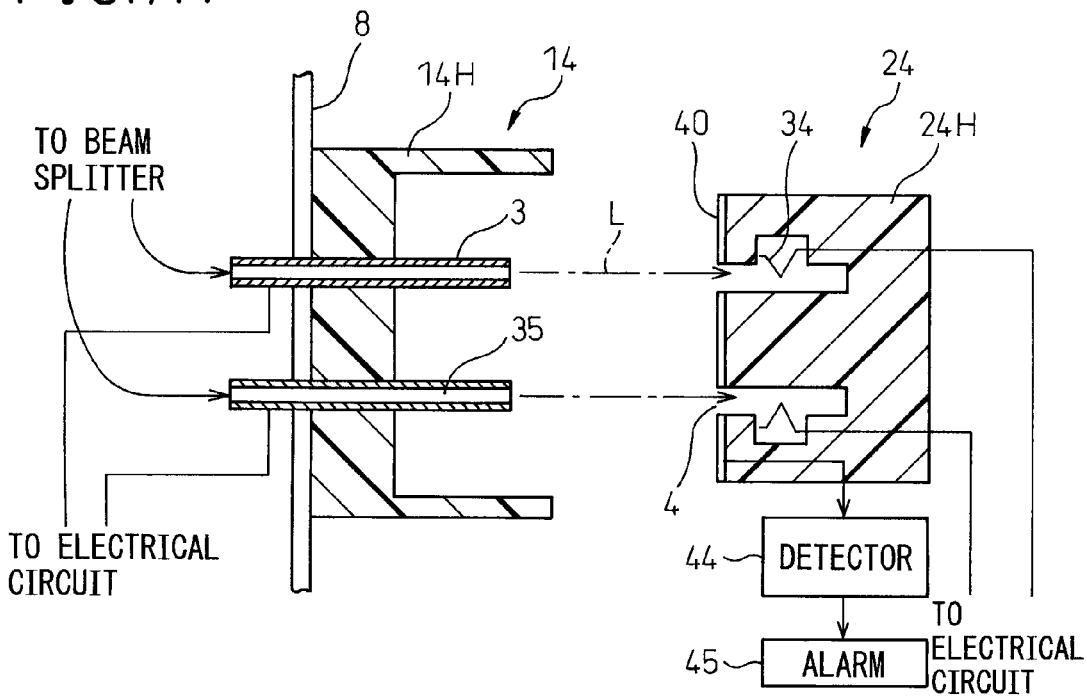
FIG. 7A is an explanatory view illustrating a specific configuration of male/female connectors of the fourth embodiment and connection with an alarm.

FIG. 7A illustrates the specific configuration of male/female connectors 14, 24 of a fourth embodiment. The configuration of the fourth embodiment resembles the configuration of the third embodiment, so only the points of difference will be described. The connector 13 of the third embodiment was provided with light receiving units 38 at the base parts of the pins 3 of the housing 13H, but the connector 14 of the fourth embodiment is not provided with anything at all at the base parts of the pins 3 of the housing 14H. Further, the connector 23 of the third embodiment was provided with a mirror 39 around the openings of the receptacles 4 of the housing 23H, but the connector 14 of the fourth embodiment is provided with light receiving units 40 instead of the mirror 39. The light receiving units 40 are also configured by CCDs, CMOS's, or other photo-electric conversion devices and output electrical signals indicating an intensity of the received light. The light receiving units 40 are provided with a detector 44 and alarm 45 provided outside of the connector 24 in the same way as the second embodiment.

Figure 7B:
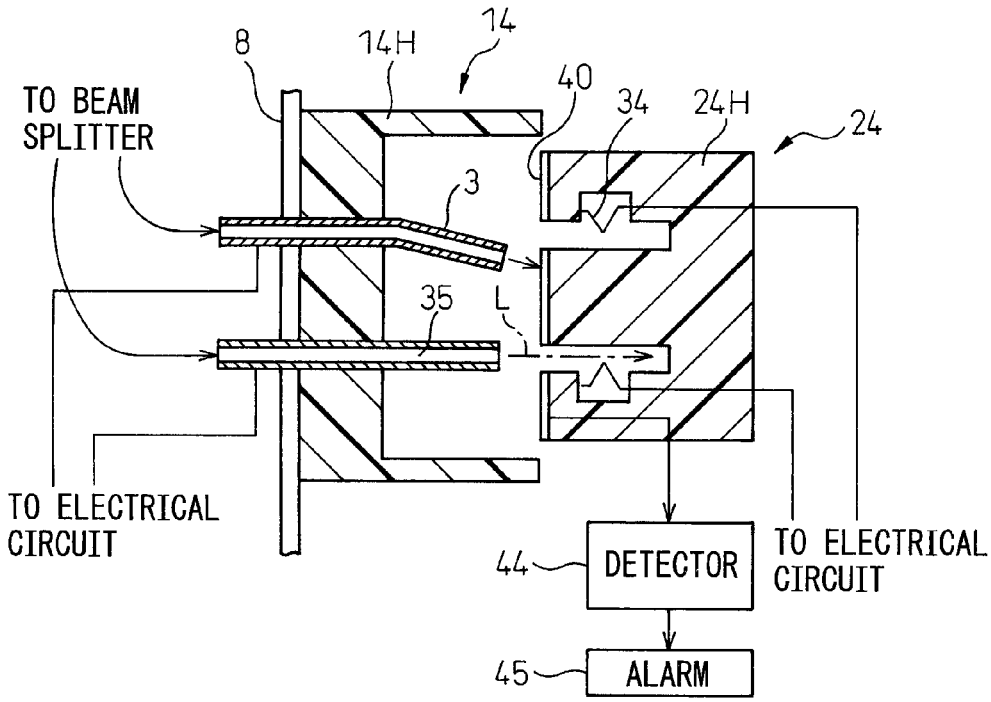
FIG. 7B is an explanatory view illustrating a state where the pins are bent when connecting male/female connectors configured as in FIG. 7A.

In such a fourth embodiment, when the pins 3 are not bent, as depicted in FIG. 7A, the laser beams L emitted from all of the light emitting units 35 of the pins 3 are input to all of the receptacles 4 in the total amount. As opposed to this, when the pins 3 are bent, as depicted in FIG. 7B, the laser beams L emitted from the light emitting units 35 of the bent pins 3 are not input to the receptacles 4, but are input to the light receiving units 40. If the light receiving units 40 detect the input of the laser beams L, they notifies this to the detector 44. The detector 44 sends a signal to the alarm 45 to make it emit an alarm sound. Due to this alarm sound, a worker can learn of bending of the pins 3 and can stop the operation of pushing the detachable module 5 into the rack 9 in the middle.

Figure 8:
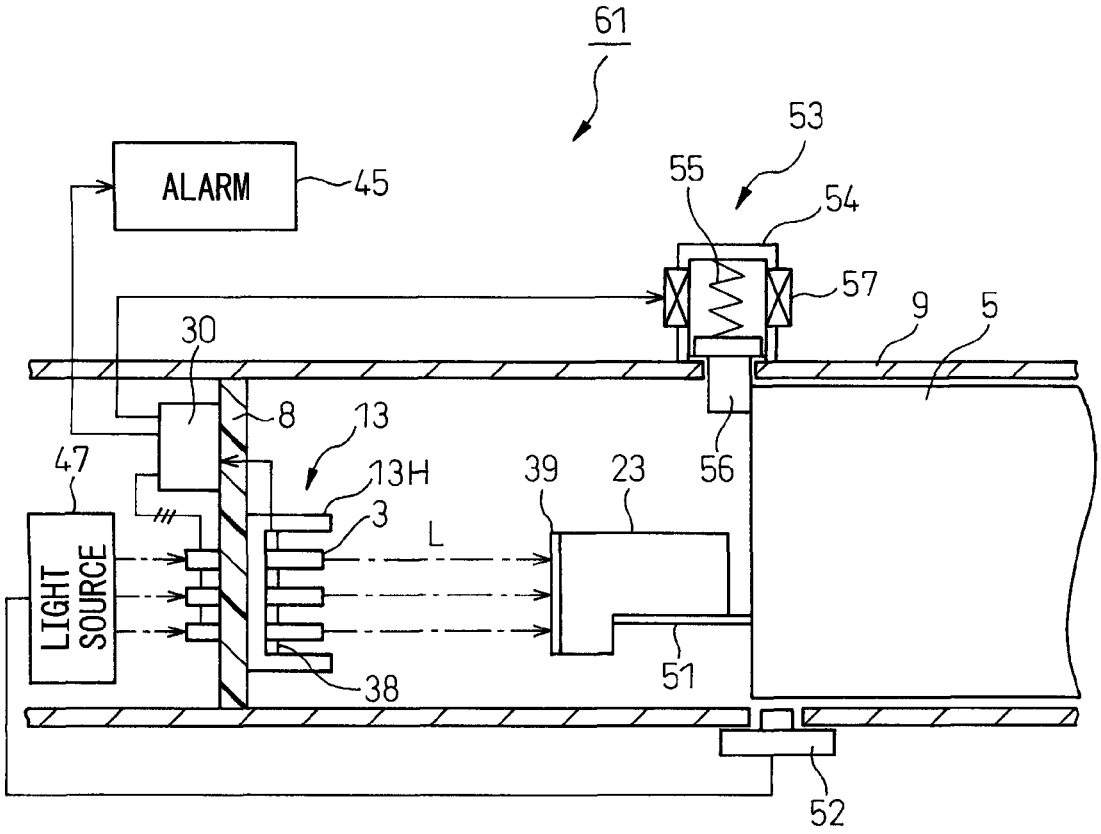
FIG. 8 is an explanatory view for illustrating a state, in an electronic apparatus of a first embodiment including a rack and a detachable module to which connectors of the third embodiment illustrated in FIGS. 6A and 6B are attached, where the detachable module is inserted into and connected to the rack.

FIG. 8 illustrates an electronic apparatus 61 of a first embodiment including a rack 9 to which a connector 13 and a detachable module 5 of the third embodiment illustrated in FIGS. 6A, 6B are attached and illustrates the state where a detachable module 5 is plugged into the rack 9 for connection. The light source 47 in this figure is defined as including a light emitting source and a beam splitter. Further, a circuit 30 is defined as being provided with the functions of an electrical circuit for sending and receiving signals through the connector 13 and a detector for detecting bending of the pins 3 from the signals of the light receiving units 38. A laser beam from the light source 47 is emitted from the front ends of the pins 3.

The rack 9 of the electronic apparatus 61 of the first embodiment has a sensor 52 for detecting the entry of a detachable module 5 into the rack 9. Further, the rack 9 is provided with a stopper 53 for stopping the entry of a detachable module 5 into the rack 9 at a point of time before the connector 23 connects with the connector 13. The stopper 53 includes a casing 54, spring 55, plunger 56, and solenoid 57. The plunger 56 is biased by the spring 55 in the casing 54. The front end sticks out into the rack 9. The solenoid 57, when energized, pulls in the plunger 56 against the spring 55 and pulls out the front end of the plunger 56 from inside the rack 9.

When a detachable module 5 to which a connector 23 provided with a mirror 39 at its front end surface is mounted enters the rack 9, the sensor 52 detects the detachable module 5 and sends a signal to the light source 47. In this case, the light source 47 sends a laser beam to the connector 13, whereupon laser beams L are fired from the front ends of the pins 3 to the connector 23. At this time, if the pins 3 are not bent, as described above, no reflected light enters the light receiving units 38, so the circuit 30 judges that the pins 3 are not bent and energizes the solenoid 57 of the stopper 53. As a result, the plunger 56 is housed in the casing 54 of the stopper 53 and the lock by the stopper 53 is released. If the stopper 53 moves inside the casing 54, the detachable module 5 can be inserted deep into the rack 9 and the connector 13 can be correctly connected with the connector 23.

On the other hand, when the pins 3 of the connector 13 are bent, if the laser beam L from the light source 47 is supplied to the connector 13 and laser beams L are emitted from the front ends of the pins 3 to the connector 23, the laser beams L are reflected at the mirror 39 provided at the front end of the connector 23 and the reflected light is input to the light receiving units 38. In this case, the circuit 30 determines that the pins 3 are bent and does not energize the solenoid 57 of the stopper 53, but sends a signal to the alarm 45 to make it emit an alarm sound. As a result, the lock by the stopper 53 is maintained and the detachable module 5 can no longer be inserted deep into the rack 9. Further, since the alarm 45 emits an alarm sound, the worker can learn of bending of the pins 3 of the connector 13.

Figure 9:
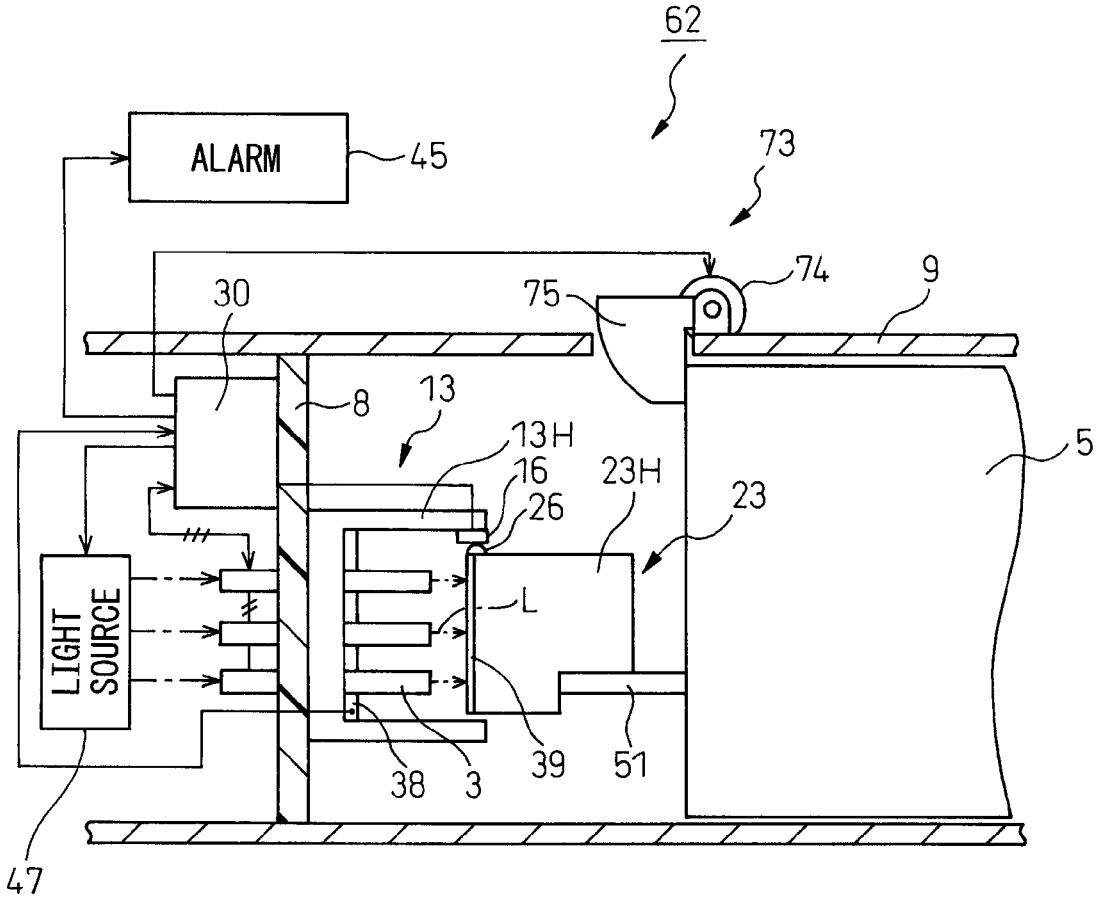
FIG. 9 is an explanatory view for illustrating a state, in an electronic apparatus of a second embodiment including a rack and a detachable module to which connectors of the third embodiment illustrated in FIGS. 6A and 6B are attached, where the detachable module is inserted into and connected to the rack.

FIG. 9 illustrates an electronic apparatus 62 of a second embodiment including a rack 9 to which a connector 13 and a detachable module 5 of the third embodiment illustrated in FIGS. 6A, 6B are attached and illustrates the state where a detachable module 5 is inserted into the rack 9 for connection. In this embodiment as well, the light source 47 includes a light emitting source and a beam splitter, while the circuit 30 is provided with an electrical circuit for sending and receiving signals through the connector 13 and a detector for detecting bending of pins 3 from signals from the light receiving units 38. A laser beam from the light source 47 is emitted from the front ends of the pins 3.

Further, the rack 9 is provided with a stopper 73. The stopper 73 stops the entry of the detachable module 5 into the rack 9 at a point of time before the connector 23 connects with the connector 13. The stopper 73 of this embodiment includes a motor 74 and a rotating plate 75. The rotating plate 75 is turned by the motor 74 to stick out inside the rack 9 and stop the entry of the detachable module 5 into the rack 9. Further, a contact 16 is provided at the front end of the housing 13 of the connector 13 attached to the board 8, while a contact 26 is provided at the front end of the housing 23H of the connector 23. The contact 16 and the contact 26 are designed to contact each other in a state where the insertion of the detachable module 5 into the rack 9 is stopped by the stopper 73.

When a detachable module 5 to which a connector 23 provided with a mirror 39 at its front end surface is attached enters into the rack 9 and is stopped by the stopper 73, the contact of the contact 16 and the contact 26 is detected by the circuit 30 and a signal is sent to the light source 47. In this case, the light source 47 supplies a laser beam to the connector 13, and laser beams L are emitted from the front ends of the pins 3 to the connector 23. At this time, if the pins 3 are not bent, as described above, no reflected light will enter the light receiving units 38, so the circuit 30 will determine that the pins 3 are not bent and power the motor 74 of the stopper 73. As a result, the rotating plate 75 will turn and leave the inside of the rack 9, whereby the lock by the stopper 73 will be released. This being the case, the detachable module 5 can be inserted deep into the rack 9 and the connector 13 and connector 23 are correctly connected.

On the other hand, when the pins 3 of the connector 13 are bent, if the light source 47 supplies a laser beam to the connector 13 and laser beams L are emitted from the front ends of the pins 3 to the connector 23, the laser beams L are reflected at the mirror 39 provided at the front end of the connector 23 and reflected light is input to the light receiving units 38. In this case, the circuit 30 determines that the pins 3 are bent, does not power the motor 74 of the stopper 73, and sends a signal to the alarm 45 to make it emit an alarm sound. As a result, the lock by the stopper 73 is maintained, and the detachable module 5 can no longer be inserted deep into the rack 9. Further, due to the alarm sound generated from the alarm 45, the worker can learn of bending of the pins 3 of the connector 13.

Figure 10:
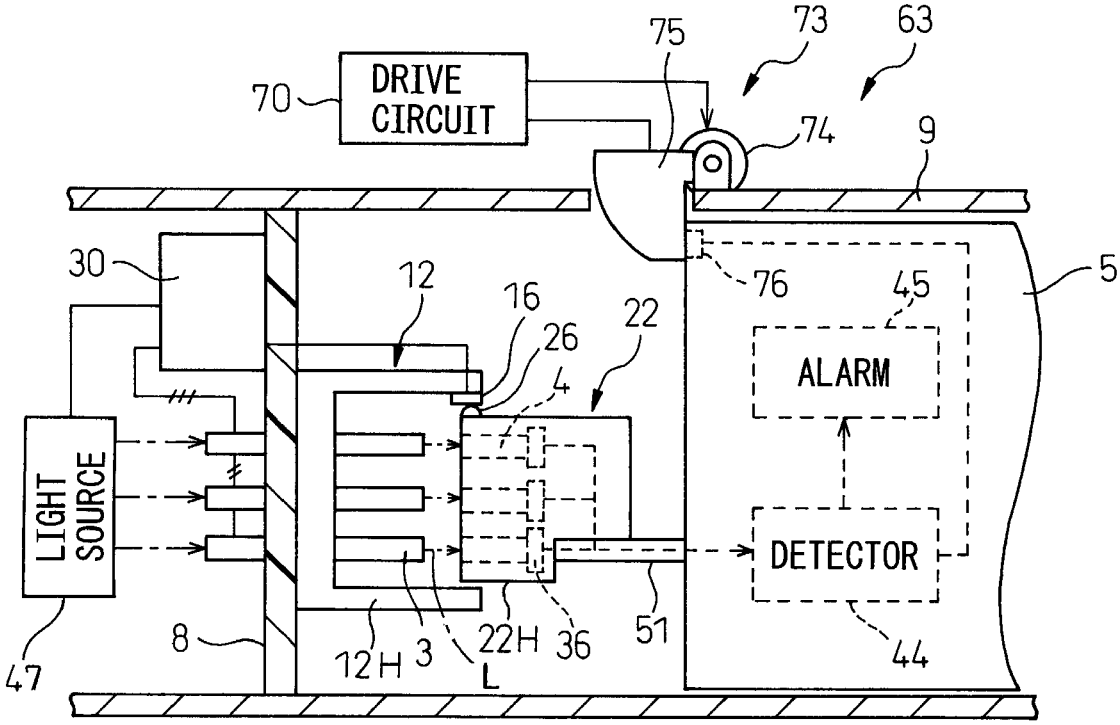
FIG. 10 is an explanatory view for illustrating a state, in an electronic apparatus of a third embodiment including a rack and a detachable module to which connectors of the second embodiment illustrated in FIG. 5 are attached, where the detachable module is inserted into and connected to the rack.

FIG. 10 illustrates an electronic apparatus 63 of a third embodiment including a rack 9 to which a connector 12 and a detachable module 5 provided with a connector 22 of the second embodiment illustrated in FIG. 5 are attached and illustrates the state where the detachable module 5 is inserted into the rack 9. In this embodiment as well, the light source 47 includes a light emitting source and a beam splitter, while the circuit 30 is provided with an electrical circuit for sending and receiving signals through the connector 12. A laser beam from the light source 47 is emitted from the front ends of the pins 3 and is input to the receptacles 4 of the connector 22. At the bottoms of the receptacles 4, there are light receiving units 36. Detection signals are output when laser beams L are input to them. The signals from the light receiving units 36 are input to a detector 44 provided in the detachable module 5.

Further, the rack 9 is provided with a stopper 73 similar to the second embodiment which stops the entry of the detachable module 5 into the rack 9 at a point of time before the connector 23 is connected to the connector 13. The stopper 73 includes a motor 74 and a rotating plate 75. The rotating plate 75 turns by the motor 74 and sticks out into the rack 9. At the detachable module 5 side, a contact 76 for contacting the rotating plate 75 is provided. This contact 76 is connected to the detector 44. The motor 74 is connected to the rotating plate 75 and driven by the drive circuit 70. Further, a contact 16 is provided at the front end of the housing 12H of the connector 12 attached to the board 8, while a contact 26 is provided at the front end of the housing 22H of the connector 22. The contact 16 and the contact 26 are designed to contact each other in the state where insertion of the detachable module 5 into the rack 9 is stopped by the stopper 73.

When a detachable module 5 to which a connector 22 including a housing 22H in which light receiving units 36 are provided enters the rack 9 and is stopped by the stopper 73, the contact of the contact 16 and the contact 26 is detected by the circuit 30, and a signal is sent to the light source 47. In this case, the light source 47 supplies a laser beam L to the connector 12, and laser beams L are emitted from the front ends of the pins 3 to the connector 22. At this time, if the pins 3 are not bent, as mentioned above, the light receiving units 36 are all struck by the laser beams, so the detector 44 determines that the pins 3 are not bent and sends a signal to the contact 76. This signal is input through the rotating plate 75 to the drive circuit 70, whereupon the drive circuit 70 powers the motor 74 of the stopper 73. As a result, the rotating plate 75 turns and leaves the inside of the rack 9, whereby the lock by the stopper 73 is released. In this case, the detachable module 5 can be inserted deep into the rack 9 and the connector 12 and the connector 22 are correctly connected.

On the other hand, when the pins 3 of the connector 12 are bent, if the light source 47 supplies a laser beam L to the connector 12 and laser beams L are emitted from the front ends of the pins 3 to the connector 22, some of the light receiving units 36 will not be struck by the laser beams L in their total amounts or will not be struck by them at all. In this case, the detector 44 determines that the pins 3 are bent, does not output a signal to the contact 76, and sends a signal to the alarm 45 to make it emit an alarm sound. As a result, the drive circuit 70 does not power the motor 74 of the stopper 73, so the lock by the stopper 73 is maintained and the detachable module 5 can no longer be inserted deep into the rack 9. Further, due to the alarm sound emitted from the alarm 45, a worker can learn that the pins 3 of the connector 13 are bent.

Figure 11:
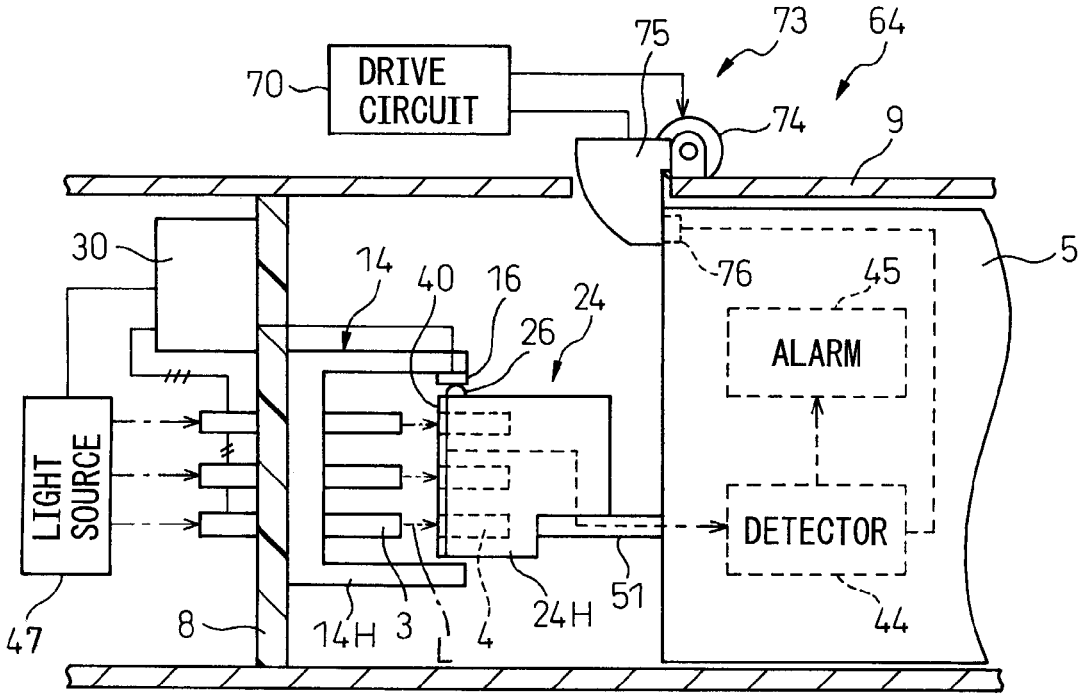
FIG. 11 is an explanatory view for illustrating a state, in an electronic apparatus of a fourth embodiment including a rack and a detachable module to which connectors of the fourth embodiment illustrated in FIGS. 7A and 7B are attached, where the detachable module is inserted into and connected to the rack.

FIG. 11 illustrates an electronic apparatus 64 of a fourth embodiment including a rack 9 to which a connector 14 is attached and a detachable module 5 provided with a connector 24 in the fourth embodiment depicted in FIG. 7A and FIG. 7B and illustrates the state where the detachable module 5 is inserted into the rack 9. The configuration of the electronic apparatus 64 of the fourth embodiment is similar to the configuration of the electronic apparatus 63 of the third embodiment, so only the points of difference will be described.

The connector 22 of the electronic apparatus 63 of the third embodiment was provided with light receiving units 36 inside the housing 22H, but the connector 24 of the electronic apparatus 64 of the fourth embodiment is not provided with the light receiving units 36. Instead, light receiving units 40 are provided at the front end surface of the housing 24H. The rest of the configuration of the electronic apparatus 64 of the fourth embodiment is the same as the configuration of the electronic apparatus 63 of the third embodiment, so an explanation will be omitted.

In the electronic apparatus 64 of this fourth embodiment, when the pins 3 are not bent, the laser beams L emitted from the pins 3 are input to the total receptacle 4 and are not input to the light receiving units 40. In this case, the detector 44 determines that the pins 3 are not bent and sends a signal to the contact 76. This signal is input through the rotating plate 75 to the drive circuit 70, whereupon the drive circuit 70 powers the motor 74 of the stopper 73. As a result, the rotating plate 75 turns and leaves the inside of the rack 9, whereupon the lock by the stopper 73 is released. In this case, the detachable module 5 can be inserted deep into the rack 9 and the connector 14 and connector 24 are correctly connected.

On the other hand, when the pins 3 of the connector 12 are bent, if laser beams L are emitted from the front ends of the pins 3 toward the connector 22, the laser beams L emitted from the bent pins 3 will not be input into the receptacles 4 in their full amounts. Part or all will be input to the light receiving units 40. In this case, the detector 44 determines that the pins 3 are bent and does not output signals to the contact 76, but sends a signal to the alarm 45 to make it emit an alarm sound. As a result, the drive circuit 70 does not power the motor 74 of the stopper 73, so the lock by the stopper 73 is maintained and the detachable module 5 can no longer be inserted deep into the rack 9. Further, due to the alarm sound emitted by the alarm 45, the worker can learn that the pins 3 of the connector 13 are bent.

Figure 12:
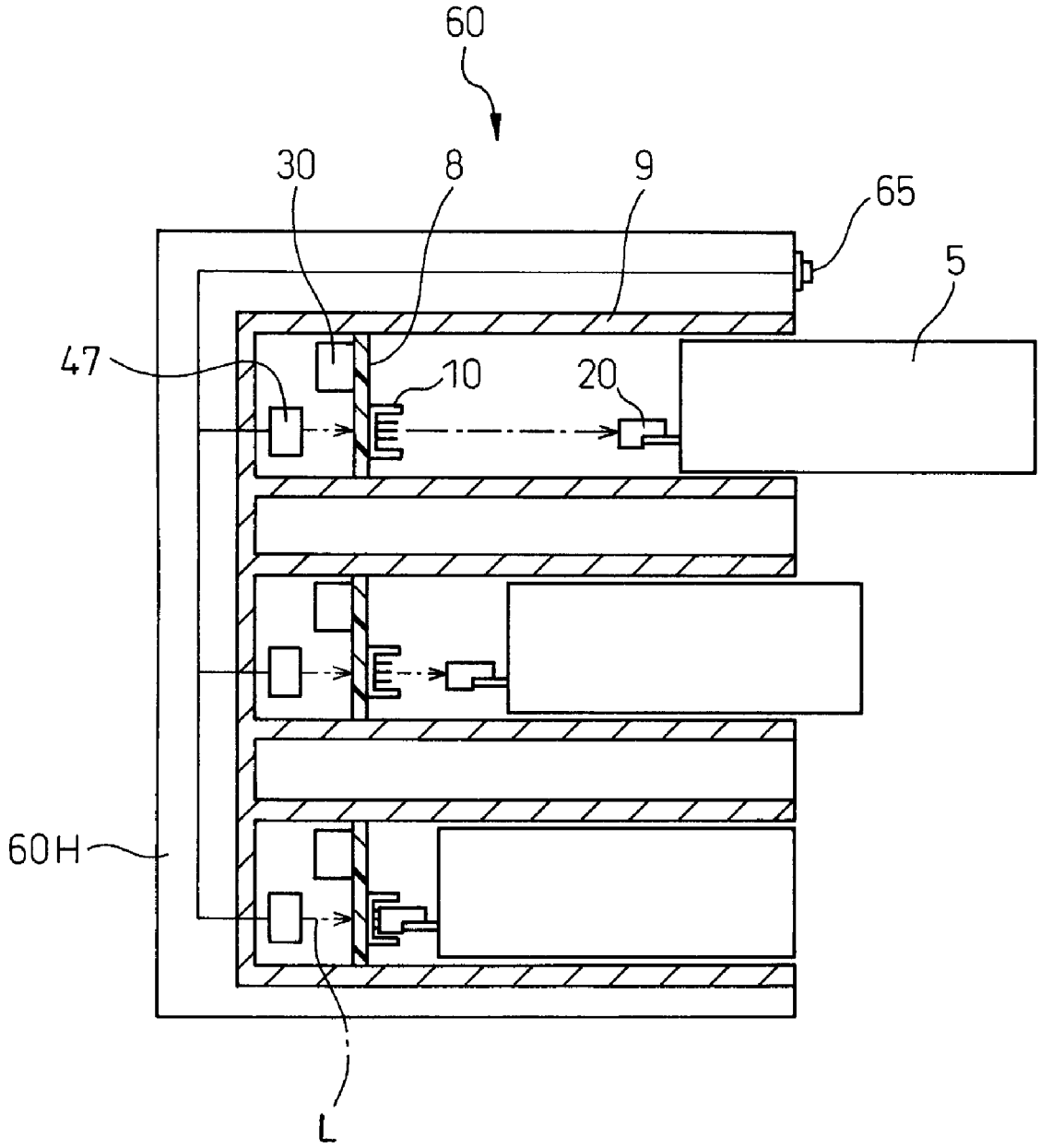
FIG. 12 is a cross-sectional view illustrating an embodiment of an electronic apparatus provided with a rack enabling mounting of a plurality of detachable modules.

FIG. 12 illustrates one embodiment of the configuration of an electronic apparatus 60 provided with a rack 9 enabling a plurality of detachable modules to be mounted. Inside a housing 60H of the electronic apparatus 60, three racks 9 are provided. A detachable module 5 can be loaded into each of these. In this embodiment, male connectors 10 are attached to boards 8, while female connectors 20 are attached to the detachable modules 5. Further, in this embodiment, an on/off switch 65 of the light source 47 is provided at a front panel of the electronic apparatus 60. If pressing this switch 65 only when plugging in the detachable modules 5 to the rack 9, laser beams L are supplied to the male connectors 10 from the light sources 47.

Note that in the embodiment illustrated above, a configuration providing the light sources 47 at the connectors at the rack 9 side was described, but the light sources 47 can also be provided at the detachable modules 5. In this case, it is sufficient to mount batteries for powering the light sources at the detachable modules 5, provide switches there, and turn on the switches when inserting the units so as to make the light sources emit light.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An electronic apparatus at which at least one detachable module is attached to a casing, provided with a first connector which is attached to a board provided in said casing corresponding to each of said modules and which has a plurality of parallel pins, a second connector which is provided at a surface of each of said modules for connection with said casing and which has receptacles corresponding to said pins, and a monitoring unit which monitors the states of the pins before connection of said first and second connectors, said monitoring unit provided with an emission instructing unit which instructs the emission of light to all of the pairs of said pins and said receptacles of said first and second connectors from one to the other, a pin state detecting unit which detects whether the emitted light has arrived at all of the pairs of said pins and said receptacles to thereby detect the states of the pins, and a pin abnormality detecting unit which determines said pins are abnormal and emits an alarm when the emitted light does not arrive at least at one of said pairs.

2. An electronic apparatus according to claim 1, wherein said emission instructing unit instructs the emission of light from inside said pins toward bottoms of said receptacles, and, when there are light receiving units for said emitted light at said bottoms and said emitted light does not arrive at all of the light receiving units, said pin abnormality detector detects that said pins are abnormal.

3. An electronic apparatus according to claim 1, wherein said emission instructing unit instructs the emission of light from around said pins to around openings of said receptacles, and, when there are light receiving units for said emitted light around the pins and said emitted light does not arrive at least at one of the light receiving units in the total amount, said pin abnormality detector detects that said pins are abnormal.

4. An electronic apparatus according to claim 1, wherein said first connector has light receiving units at projecting surfaces of said pins, said second connector has a reflecting part at a surface with openings of said receptacles, said emission instructing unit instructs emission of light from insides of said pins toward bottoms of said receptacles, and, when said light receiving units receive input of reflected light from said reflecting part, said pin abnormality detector detects that said pins are abnormal.

5. An electronic apparatus according to claim 1, wherein said second connector has light receiving units at a surface with openings of said receptacles, said emission instructing unit instructs emission of light from insides of said pins toward bottoms of said receptacles, and, when said light receiving units receive input of said emitted light, said pin abnormality detector detects that said pins are abnormal.

6. An electronic apparatus according to claim 1, wherein said apparatus is further provided with a module insertion detecting unit which detects insertion of said module into said casing, and said monitoring unit instructs emission of light based on an inserted state of said module.

7. An electronic apparatus according to claim 6, wherein said monitoring unit instructs emission of light for exactly a predetermined time after the module insertion detecting unit detects insertion of said module.

8. An electronic apparatus according to claim 1, wherein said apparatus is further provided with an insertion preventing unit for said module, and said monitoring unit uses said insertion preventing unit to prevent insertion of said module when the states of the pins are abnormal.

9. An electronic apparatus according to claim 1, wherein said detachable module is provided with a signal input unit, said emission instructing unit instructs emission of light from said second connector toward said first connector, and said monitoring unit instructs emission of light to said emission instructing unit based on a predetermined signal input from said signal input unit.

10. An electronic apparatus according to claim 1, wherein said apparatus is further provided with an insertion preventing unit for said module, said emission instructing unit instructs emission of light from said second connector toward said first connector, and said monitoring unit uses said insertion preventing unit to prevent insertion of said module when the states of the pins are abnormal.

11. A connector module provided with a first connector in which a plurality of pins are arranged in parallel and a second connector having receptacles corresponding to the pins, the connector module characterized by being provided with a light emitting unit which emits light from one to the other of a pair of a pin and receptacle of the first and second connectors for all of the pairs, a light receiving unit which is provided at either one of the pin side and the receptacle side and outputs detection output indicating if the emitted light has been normally received at all of the pairs in accordance with the received state of the emitted light, and a detecting unit which uses the detection output from the light receiving unit to detect if the pins are normal in state.

12. A connector module according to claim 11, wherein said light emitting unit is provided inside each of said pins so that said emitted light is emitted from a front end of said pin toward an opening of said receptacle, said light receiving unit is provided at a projecting surface of said pin of said first connector, said second connector is further provided with a reflecting part at a surface with openings of said receptacles.

13. A connector module according to claim 11, wherein said light emitting unit is provided inside each of said pins so that said emitted light is emitted from a front end of said pin toward an opening of said receptacle, and said light receiving unit is provided at a bottom of each opening of said second connector.

14. A connector module according to claim 11, wherein said light emitting unit is provided inside each of said pins so that said emitted light is emitted from a front end of said pin toward an opening of said receptacle, and said light receiving unit is provided at an end surface of said second connector other than at said receptacles.

15. A connector module according to claim 11, wherein said light emitting unit is provided around each of said pins so as to emit light to around an opening of a receptacle, and said light receiving unit is provided around an opening of each receptacle.

16. A connector module according to claim 13, wherein said detecting unit is comprised of a photo-electric conversion device provided at a bottom of each of said receptacles and a detector which detects bending of said pins based on electrical signals from the photo-electric conversion devices.

17. A connector module according to claim 11, wherein said module is provided with an alarm which is connected to a detecting unit of said connector and wherein said detecting unit activates said alarm when detecting that said pins are bent.

18. A connector module according to claim 11, wherein each of said light emitting units is provided with a light guide member which is provided inside said pin so that said emitted light is emitted from a front end of said pin toward an opening of a receptacle, and light of a high linearity is input from an end surface of a back side of said pin to said light guide member.

19. A connector module according to claim 15, wherein each said light emitting unit is provided by forming a light guide member inside a body of said first connector, one end of said light guide member is exposed at a side surface of the body of said connector, another end is exposed around a part where said pin is provided at said connector body, and light of a high linearity is input from an exposed end of a side surface of the body of said connector to said light guide member.

20. An electronic apparatus according to claim 1, wherein said casing is configured to enable mounting of a plurality of detachable modules, a panel of said casing at an insertion side of said modules is provided with an on/off switch of said emission instructing unit, and said emission instructing unit instructs emission of light only when said on/off switch is in an on state.

* * * * *